US011020982B2

(12) United States Patent
Vidal, Jr. et al.

(10) Patent No.: US 11,020,982 B2
(45) Date of Patent: Jun. 1, 2021

(54) PRINTHEAD RECIRCULATION

(71) Applicant: HEWLETT-PACKARD DEVELOPMENT COMPANY, L.P., Houston, TX (US)

(72) Inventors: Joan Vidal, Jr., Barcelona (ES); Lluis Abello, Tarragona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 249 days.

(21) Appl. No.: 16/068,031

(22) PCT Filed: Jun. 27, 2016

(86) PCT No.: PCT/EP2016/001090
§ 371 (c)(1),
(2) Date: Jul. 3, 2018

(87) PCT Pub. No.: WO2018/001441
PCT Pub. Date: Jan. 4, 2018

(65) Prior Publication Data
US 2020/0269597 A1 Aug. 27, 2020

(51) Int. Cl.
*B41J 2/18* (2006.01)

(52) U.S. Cl.
CPC ..... *B41J 2/18* (2013.01)

(58) Field of Classification Search
CPC ..... B41J 2/18; B41J 2202/12; B41J 2/1404
See application file for complete search history.

(56) References Cited

U.S. PATENT DOCUMENTS

| | | | |
|---|---|---|---|
| 6,357,852 | B1 | 3/2002 | Premnath et al. |
| 8,814,293 | B2 | 8/2014 | Strunk et al. |
| 9,156,262 | B2 | 2/2015 | Taff et al. |
| 9,211,721 | B2 | 12/2015 | Govyadinov et al. |
| 9,315,019 | B2 | 4/2016 | Govyadinov |
| 9,901,952 | B2 | 2/2018 | Govyadinov et al. |
| 2010/0165023 | A1 | 7/2010 | Yoshihumi |
| 2010/0327025 | A1 | 12/2010 | Yokoyama |
| 2015/0091989 | A1 | 4/2015 | Govyadinov |
| 2016/0082745 | A1 | 3/2016 | Govyadinov |
| 2016/0368266 | A1 | 12/2016 | Govyadinov et al. |

FOREIGN PATENT DOCUMENTS

| | | | |
|---|---|---|---|
| CN | 1623785 | | 6/2005 |
| CN | 104228349 | | 12/2014 |
| EP | 0448967 | A1 | 10/1991 |
| EP | 1525985 | A1 | 4/2005 |
| EP | 2837497 | A2 | 2/2015 |
| JP | 2006272853 | | 10/2006 |
| WO | WO 2014/007814 | A1 | 1/2014 |

(Continued)

OTHER PUBLICATIONS

IP.com search (Year: 2020).*

(Continued)

*Primary Examiner* — Lisa Solomon
(74) *Attorney, Agent, or Firm* — Dierker & Kavanaugh PC

(57) ABSTRACT

A method of recirculating fluid in a printhead die is provided. The recirculation is performed for at least one nozzle, such that the recirculation finishes before the corresponding at least one nozzle completed ejection of a drop.

15 Claims, 8 Drawing Sheets

(56) References Cited

FOREIGN PATENT DOCUMENTS

| | | |
|---|---|---|
| WO | WO 2016/068987 A1 | 5/2016 |
| WO | WO 2016/068988 | 5/2016 |
| WO | WO-2016068988 | 5/2016 |

OTHER PUBLICATIONS

Evaluation of the Direct Inkjet Printing Method for the Fabrication of Three-dimensional Ceramic Components, Sep. 24, 2012, < http://publications.rwth-aachen.de/record/65385/files/4291.pdf >.

* cited by examiner

PRINTHEAD RECIRCULATION

BACKGROUND

Fluid ejection devices may be implemented in various applications, such as printheads in printing systems including inkjet printers. Some fluid ejection devices may recirculate fluid.

BRIEF DESCRIPTION OF THE DRAWINGS

Examples will be described, by way of example only, with reference to the accompanying drawings in which corresponding reference numerals indicate corresponding parts and in which.

DETAILED DESCRIPTION

Figure 1:
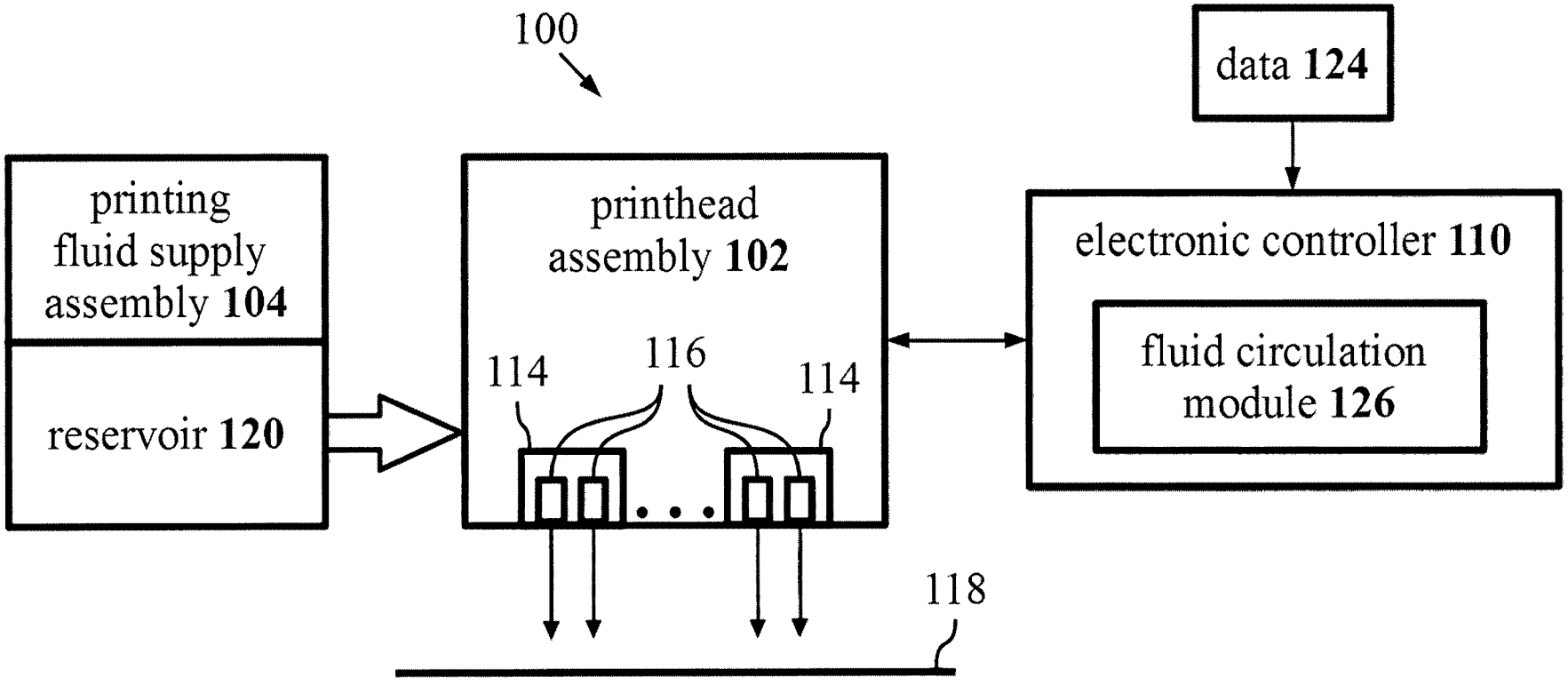
FIG. 1 illustrates an example of a printing system suitable for implementing an example method of recirculating fluid according to an example.

In general, a printing system, for example an inkjet printer or a 3D printing system, may include a fluid ejection device, such as a printhead, a printing fluid supply which supplies printing fluid to the fluid ejection device, and a controller which controls the fluid ejection device. Fluid ejection devices, for example printheads, may provide drop-on-demand ejection of fluid drops. In some examples, fluid ejection devices may be implemented in printing systems to facilitate on-demand ejection of printing fluid drops. In some examples, fluid ejection devices may be implemented in lab-on-a-chip devices (e.g., polymerase chain reaction devices, chemical sensors, etc.), fluid analysis devices, digital titration devices, pharmaceutical dispensation devices, fluidic diagnostic circuits, and/or other such devices in which volumes of fluids may be dispensed/ejected.

Printing systems may produce images or object layers by ejecting printing fluid drops, for example drops of liquid ink or drops of print agents, through a plurality of orifices or nozzles onto a print medium or a layer of print material, respectively. A print medium may be any kind of sheet-like medium, such as paper, cardboard, plastic or textile, etc., or a kind of layer of print material in case of a 3D printing system. In some example printing systems, fluid ejection devices may be implemented to print content by deposition of consumable fluids in a layer-wise additive manufacturing process. Examples of fluids, such as printing fluids, may comprise ink, toner, colorants, varnishes, finishes, gloss enhancers, binders, and/or other such materials. Images refers to any kind of depiction of signs, symbols, characters, numbers, letters, text and/or graphics which may be applied to the print medium, or to an object layer which may be applied to a layer of print material.

In some examples, the nozzles may be arranged in one or more columns or arrays such that properly sequenced ejection of printing fluid from the nozzles may cause images to be printed upon the print medium as the fluid ejection device and the print medium are moved relative to each other. In some examples, the arrays of nozzles may be arranged on dies or die substrates on the fluid ejection device.

In some examples, the fluid ejection device may eject fluid from a nozzle by activating a fluidic actuator which is in fluid communication with the nozzle. In some examples, the actuator may be a thermal resistor element and drops of fluid may be ejected from the nozzle by passing electrical current through the resistor element to generate heat and vaporize a small portion of the fluid within an ejection chamber. Some of the fluid may be displaced by the vapor bubble and may be ejected through the nozzle. In some examples, the actuator may be a piezoelectric element and drops of fluid may be ejected from the nozzle by passing electrical pulses to the piezoelectric element, causing a physical displacement which may generate pressure pulses that may force fluid out of the nozzle.

In some examples, a remote controller which may be located, e.g. as part of the processing electronics of a printer, controls the timing and activation of an electrical current from a power supply external to the fluid ejection device with a fire pulse. In some examples, the electrical current may be passed through a selected actuator to displace the fluid in a corresponding selected ejection chamber. In some examples, the ejection chamber may be coupled with one nozzle. In other examples, the ejection chamber may be coupled with a plurality of nozzles.

In some examples of printing systems, fluid ejection devices, such as printheads, may receive fire signals containing fire pulses from the controller. For example, the fire signal may be fed directly to the nozzles in the printhead. In other examples, the fire signal is latched in the printhead, and the latched version of the fire signal is fed to the nozzles to control the ejection of printing fluid drops from the nozzles.

In some examples, the controller of the printer may maintain control of all timing related to the fire signal. In some examples, the timing related to the fire signal primarily refers to the actual width of the fire pulse and the point in time at which the fire pulse occurs. The controller may control the timing related to the fire signal for printheads capable of printing a single column at a time. Such printheads may only need one fire signal to the printhead to control the ejection of printing fluid drops from the printhead.

In other examples, the printhead may have the capability of printing multiple columns of the same color or multiple columns of different colors simultaneously.

In some examples, a plurality of individual fluid ejection devices may be mounted on a single carrier. In some examples, a plurality of printheads may be mounted on a single carrier, where such examples may be referred to as wide-array inkjet printing systems. In such examples, fluid ejection devices thereof may have the capability of printing multiple columns of the same color or multiple columns of different colors simultaneously. In some examples, a number of nozzles and, therefore, an overall number of printing fluid drops which can be ejected per second may be increased. Since the overall number of drops which can be ejected per second may be increased, printing speed can be increased with a wide-array inkjet printing system and/or printheads having the capability of printing multiple columns simultaneously.

Thus, in some examples, a number of electrical pulses, i.e. fire pulses, may be generated which may be applied to one or more actuators, causing the corresponding nozzles to eject drops of printing fluid through the nozzles onto the print medium.

Although the present invention is described herein by way of example for a two-dimensional (2D) printing system, it is not limited thereto. The method and system according to the present invention can be readily applied to other printing systems, such as, for example, a three-dimensional (3D) printing system as well as other fluid dispensation/ejection related systems and devices.

In some examples, 3D printing techniques may involve the combined application of successive layers of material. For example, a printing fluid, such as a printing agent, may be applied to a layer of print material to produce an object layer.

FIG. 1 illustrates an example of a printing system 100 suitable for implementing an example of fluid recirculation according to an embodiment of the disclosure. Printing system 100 may include a printhead assembly 102, a printing fluid supply assembly 104, and an electronic controller 110. The various electrical components of printing system 100 may be connected with at least one power supply (not shown) that provides power thereto.

Printhead assembly 102 includes at least one fluid ejection device 114, such as a printhead 114, which ejects drops of printing fluid, for example liquid ink, through a plurality of orifices or nozzles 116 toward a print medium 118. Nozzles 116 may be arranged in one or more columns or arrays such that properly sequenced ejection of printing fluid from nozzles 116 may cause, for example characters, symbols, and/or other graphics or images to be printed on print media 118 as printhead assembly 102 and print media 118 are moved relative to each other. Printing fluid supply assembly 104 may supply printing fluid to printhead assembly 102 from a printing fluid reservoir 120 through an interface connection, such as a supply tube. The reservoir 120 may be removed, replaced, and/or refilled.

In some examples, as illustrated in FIG. 1, printing fluid supply assembly 104 and printhead assembly 102 may form a one-way printing fluid delivery system. In a one-way printing fluid delivery system, substantially all of the printing fluid supplied to printhead assembly 102 may be consumed during printing. In other examples (not shown), printing fluid supply assembly 104 and printhead assembly 102 may form a recirculating printing fluid delivery system. In a recirculating printing fluid delivery system, only a portion of the printing fluid supplied to printhead assembly 102 may be consumed during printing. Printing fluid not consumed during printing may be returned to printing fluid supply assembly 104.

In some examples, electronic controller 110 may include components of a standard computing system, such as a processor, memory, firmware, software, and other electronics for controlling the general functions of system 100 and for communicating with and controlling system components such as printhead assembly 102. In some examples, electronic controller 110 may receive data 124 from a host system, such as a computer, and may temporarily store data 124 in a memory. In some examples, data 124 may be sent to printing system 100 along an electronic, infrared, optical, or other information transfer path. Data 124 may represent, for example, a document, a file and/or a 3D object to be printed. As such, data 124 may form a print job for printing system 100 and may include one or more print job commands and/or command parameters.

In some examples, controller 110 may control printhead assembly 102 for ejection of printing fluid drops from nozzles 116. Thus, electronic controller 110 may define a pattern of ejected printing fluid drops which may form, for example characters, symbols, and/or other graphics or images on print media 118. The pattern of ejected printing fluid drops may be determined by the print job commands and/or command parameters. For example, controller 110 may generate a series or a pattern of fire pulses that may be sent to fluidic actuators to determine the pattern of ejected printing fluid drops.

In some examples, controller 110 may include fluid circulation module 126 stored in a memory of controller 110. Fluid circulation module 126 may execute on controller 110, i.e. a processor of controller 110, to control the operation of one or more pump actuators within fluid ejection device 114. More specifically, in some examples controller 110 may execute instructions from fluid circulation module 126 to control which pump actuators within fluid ejection device 114 are active and which are not active. Controller 110 may also control the timing of activation for the pump actuators.

In other examples, controller 110 may execute instructions from module 126 to control the timing and duration of forward and reverse pumping strokes, i.e. compressive and expansive fluid displacements, respectively, of the pump actuators to control, for example the direction, rate, and timing of fluid flow through fluidic channels between fluid feed slots within fluid ejection device 114.

In some examples, printhead assembly 102 may include one fluid ejection device (printhead) 114. In other examples, printhead assembly 102 may include a plurality of printheads 114. For example, printhead assembly 102 may be a wide array or a multi-head printhead assembly. In one implementation of a wide-array assembly, printhead assembly 102 may include a carrier that carries printheads 114, provides electrical communication between printheads 114 and controller 110, and provides fluidic communication between printheads 114 and ink supply assembly 104.

In some examples, printing system 100 may be a drop-on-demand thermal inkjet printing system wherein the fluid ejection device 114 is a thermal inkjet (TIJ) printhead. The thermal inkjet printhead implements a thermal resistor ejection element in an ink chamber to vaporize ink and create bubbles that force ink or other printing fluid drops out of a nozzle 116. In other examples, printing system 100 is a drop-on-demand piezoelectric inkjet printing system wherein the fluid ejection device 114 is a piezoelectric inkjet (PIJ) printhead that implements a piezoelectric material actuator as an ejection element to generate pressure pulses that force printing fluid drops out of a nozzle.

Figure 2:
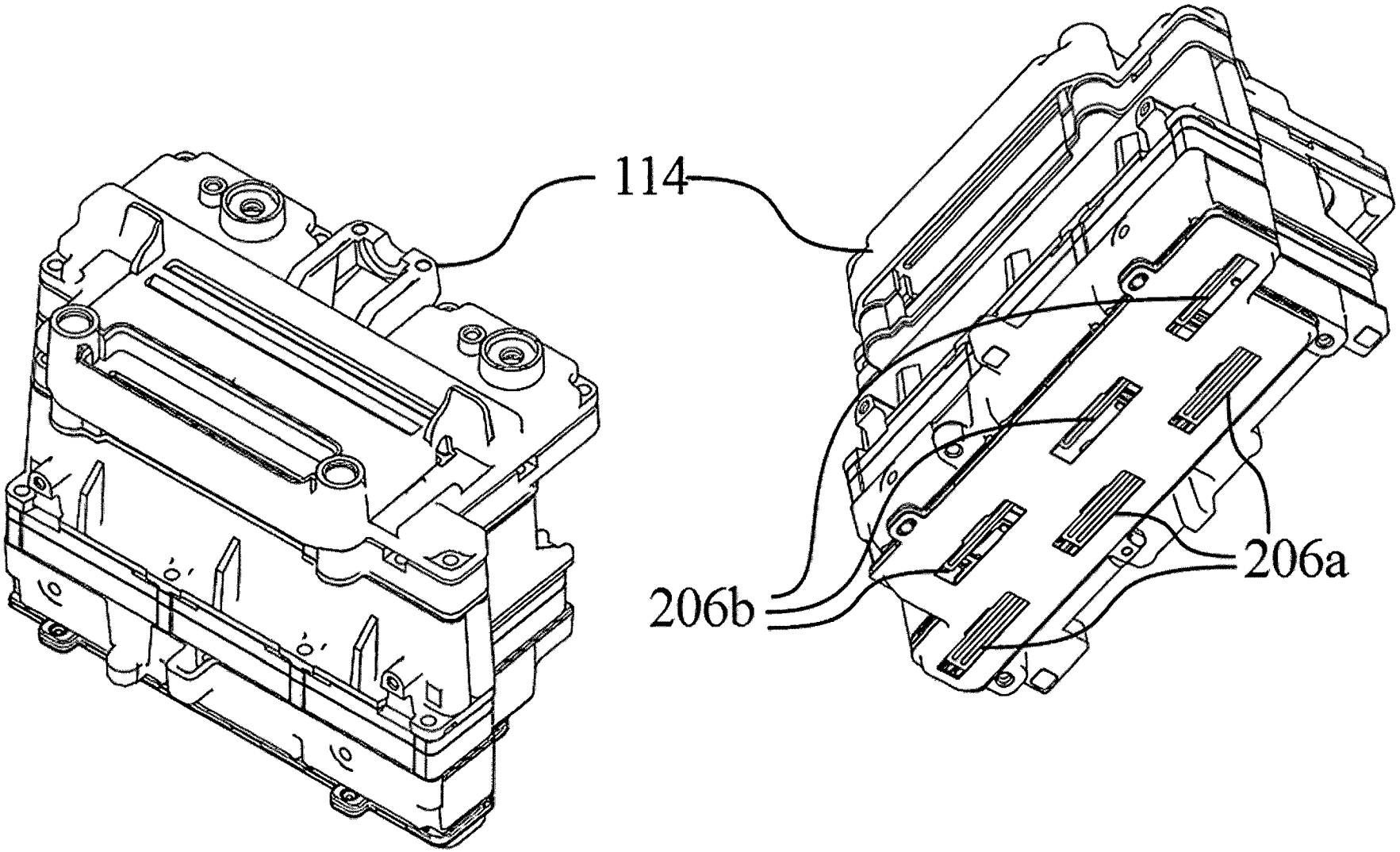
FIG. 2 illustrates an example printhead in two different views, according to an example.

FIG. 2 illustrates an example printhead 114 in two different views, a top view (left) and a bottom view (right). In some examples, the printhead 114 may comprise a plurality of thermal inkjet chips, referred to as dies 206*a*, 206*b*. For example, the printhead 114 comprises six dies 206*a*, 206*b*. In some examples, the number of dies 206*a*, 206*b* may be fewer, such as two or four dies 206*a*, 206*b*, or greater than six, such as eight or ten dies 206*a*, 206*b*. The dies 206*a*, 206*b* may be precision-aligned and placed on a dimensionally stable substrate. In some examples, the substrate may provide, for example mechanical alignment, printing fluid supply channels and electrical interconnection (not shown).

In some examples, the dies 206*a*, 206*b* may be arranged in two rows, a row of even dies 206*a* and a row of odd dies 206*b* at the bottom of the printhead 114. Each die 206*a*, 206*b* may comprise at least one array of nozzles (not shown). In some examples, each die 206*a*, 206*b* comprises one array of nozzles for each color. For example, each die 206*a*, 206*b* may comprise four arrays of nozzles for each of four colors to be printed.

In some examples, the printhead 114 has no moving parts. The printhead 114 may eject drops of printing fluid through the nozzles. The ejection of printing fluid may be triggered by the controller 110. In some examples, each drop has to emerge at a consistent weight, speed and direction to place a dot of correct size in the correct location. In some examples, the distance between the printheads 114 and the print medium 118 may be controlled accurately.

Figure 3:
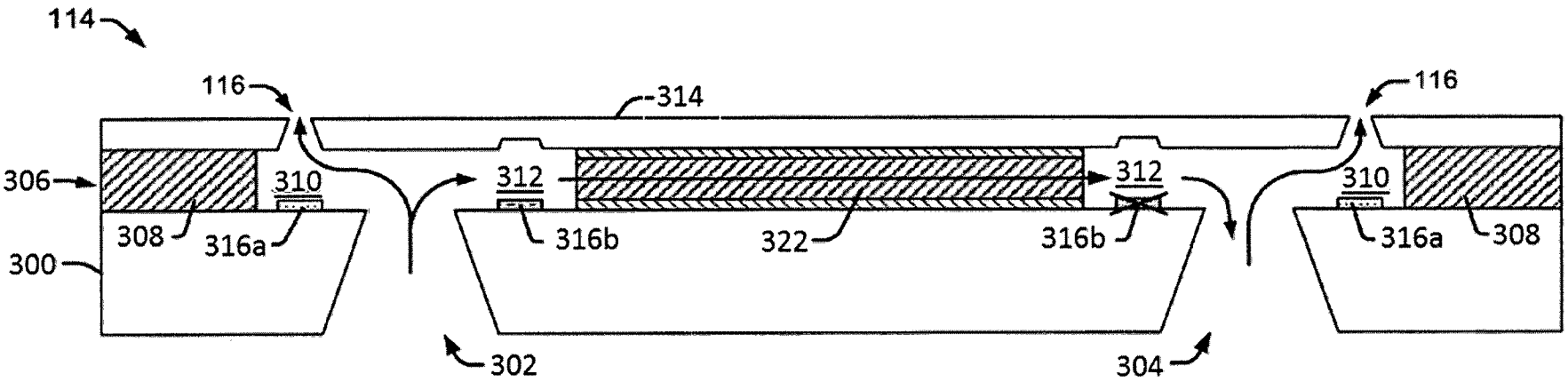
FIG. 3 is a cross-sectional view of a printhead, according to an example.

FIG. 3 is a cross-sectional view of a printhead 114 according to an example of the disclosure. Printhead 114 may include a die substrate 300, for example a silicon die substrate, with a first fluid supply slot 302 and a second fluid supply slot 304 formed therein. Fluid slots 302 and 304 may be elongated slots that may be in fluid communication with a fluid supply (not shown), such as a fluid reservoir 120 (cf. FIG. 1). Although in this example the concept of slot-to-slot fluid circulation is described, the method and system disclosed herein are not limited thereto. Other fluid circulations, such as fire chamber to fire chamber, slot to fire chamber, pump chamber to slot, pump chamber to fire chamber, etc. may be realized.

While slot-to-slot fluid circulation is described with respect to fluid ejection devices having two fluid slots, such concepts are not limited in their application to devices with two fluid slots. Rather, fluid devices having more than two fluid slots, such as four, six or eight slots, for example, are also contemplated as being suitable devices for implementing slot-to-slot fluid circulation. In addition, in other embodiments the configuration of the fluid slots may vary. For example, the fluid slots in other embodiments may be of varying shapes and sizes such as round holes, square holes, square trenches, and so on.

In some examples, printhead 114 may include a chamber layer 306 having walls 308 that define fluid chambers 310, 312, and that separate the substrate 300 from a nozzle layer 314 having nozzles 116. Fluid chambers 310 and 312 may comprise, respectively, fluid ejection chambers 310 and fluid pump chambers 312. Fluid chambers 310 and 312 may be in fluid communication with a fluid slot. Fluid ejection chambers 310 have nozzles 116 through which fluid is ejected by actuation of a fluid displacement actuator 316 (i.e., a fluid ejection actuator 316*a*).

In some examples, fluid pump chambers 312 may be closed chambers in that they do not have nozzles through which fluid is ejected. Actuation of fluid displacement actuators 316 (i.e., fluid pump actuators 216*b*) within pump chambers 312 may generate fluid flow between slot 302 and 304. In other examples, fluid displacement actuators 316 may be provided in a channel without having a pump chamber.

In some examples, chambers 310 and 312 may form columns of chambers along the inner and outer sides of slots 302 and 304. For example, chambers 310 and 312 may form external columns and internal columns. External columns may be adjacent to a fluid slot 302 or 304 and located between the slot 302, 304 and an edge of the substrate 300. Internal columns may be adjacent to fluid slots 302 and 304 and located between the slot 302, 304 and the center of the substrate 300.

In some examples, chambers in the external columns are fluid ejection chambers 310, while chambers in the internal columns 320 are fluid pump chambers 312. In other examples, however, the external and internal columns can include both fluid ejection chambers 310 and fluid pump chambers 312.

Fluid displacement actuators 316 are described generally throughout the disclosure as being elements capable of displacing fluid in a fluid ejection chamber 310 for the purpose of ejecting fluid drops through a nozzle 116, and/or for generating fluid displacements in a fluid pump chamber 312 for the purpose of creating fluid flow between slots 302 and 304.

One example of a fluid displacement actuator 316 is a thermal resistor element. When activated, heat from the thermal resistor element vaporizes fluid in the chamber 310, 312, causing a growing vapor bubble to displace fluid. Another example of a fluid displacement actuator 316 is a piezoelectric element. The piezoelectric element may include a piezoelectric material adhered to a moveable membrane formed at the bottom of the chamber 310, 312. When activated, the piezoelectric material causes deflection of the membrane into the chamber 310, 312, generating a pressure pulse that displaces fluid.

In addition to thermal resistive elements and piezoelectric elements, other types of fluid displacement actuators 316 may also be suitable for implementation in a fluid ejection device 114 to generate, e.g. slot-to-slot fluid circulation. For example, printheads 114 may implement electrostatic (MEMS) actuators, mechanical/impact driven actuators, voice coil actuators, magneto-strictive drive actuators, and so on.

In some examples, as shown in FIG. 3, a fluid ejection device 114 may include fluidic channels 322. Fluidic channels 322 extend from the first fluid slot 302 across the center of the die substrate 300 to the second fluid slot 304. In some examples, fluidic channels 322 may couple the fluid pump chambers [MJ1][CvP2]312 of the first internal column with respective fluid pump chambers 312 of the second internal column. The fluid pump chambers 312 may be in the fluidic channels 322 and may be considered to be part of the channels 322. Thus, each fluid pump chamber 312 may be located asymmetrically (i.e., off-centered) within a fluidic channel 322, toward an end of the channel.

As indicated in FIG. 3, some fluid pump actuators 316*b* are active and some are inactive. Inactive pump actuators 316*b* are designated with an "X". The pattern of active and inactive pump actuators 316*b* may be controlled by controller 110 executing fluid circulation module 126 (cf. FIG. 1) to generate fluid flow through channels 322 that circulates fluid between the first slot 302 and the second slot 304. Direction arrows show which direction fluid flows through channels 322 between slots 302 and 304. The direction of fluid flow through a channel 322 may be controlled by activating one or the other of the fluid pump actuators 316*b* at the ends of the channel 322. Thus, various fluid circulation patterns can be established between slots 302 and 304 by controlling which pump actuators 316*b* are active and which are not active. For example, controlling groups of pump actuators 316*b* to be active and inactive generates fluid flowing from the first slot 302 to the second slot 304 through some channels 322, and from the second slot 304 back to the first slot 302 through other channels 322. Channels 322 in which no pump actuator 316*b* is active have little or no fluid flow.

Figure 4:
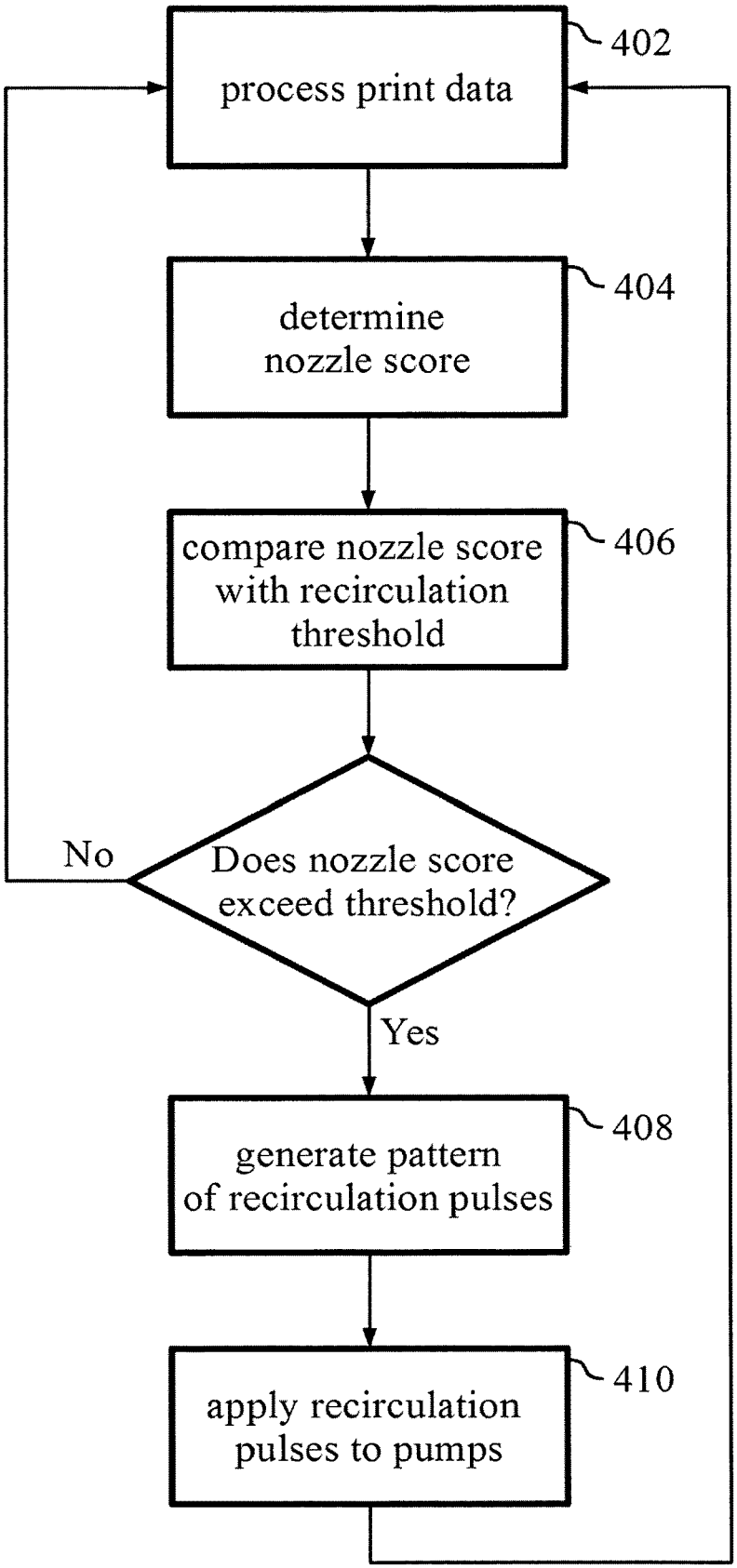
FIG. 4 is a block diagram of an example method for recirculating fluid in a printhead die according to an example.

An example method 400 for recirculating fluid in a printhead die is depicted in FIG. 4. It is to be understood that the method 400 shown in FIG. 4 will be discussed in detail herein, and in some instances, FIGS. 5 through 7 will be discussed in conjunction with FIG. 4.

As described above, an image may be printed onto a print medium by generating a series or pattern of fire pulses that activate fluidic actuators, which are in communication with corresponding nozzles. The fluidic actuators which are activated cause drops of printing fluid to be ejected through the corresponding nozzle onto the print medium, thereby printing characters or images to be printed.

The generation of fire pulses may be controlled by a controller. The controller may receive print data, which represents, for example, the image to be printed. The print data may be processed by the controller, e.g. by a processor of the controller, and forms a print job for the printing system including print job commands and/or command parameters. Thus, by processing the print data, the controller can control the timing of drop ejection and which nozzle(s) have to eject drops of printing fluid onto the print medium at what printing column.

In some examples, inkjet printheads used in inkjet printing systems may have problems with printing fluid blockage and/or clogging. For example, a cause of printing fluid blockage may be an excess of air that accumulates as air bubbles in the printhead. For example, when printing fluid is exposed to air, such as while the printing fluid is stored in a reservoir, additional air may dissolve into the printing fluid. The subsequent action of ejecting printing fluid drops from the ejection chamber of the printhead may release excess air from the printing fluid, which then may accumulate as air bubbles. The bubbles may move from the ejection chamber to other areas of the printhead where they may block the flow of printing fluid to the printhead and within the printhead. Bubbles in the ejection chamber absorb pressure, reducing the force on the fluid pushed through the nozzle, which may reduce drop speed or prevent ejection.

In some examples, inkjet printing systems may use pigment-based inks or dye-based inks as printing fluids. Pigment-based inks may also cause printing fluid blockage or clogging in printheads due to pigment-ink vehicle separation (PIVS). PIVS may be a result of water evaporation from ink in the nozzle area and pigment concentration depletion in ink near the nozzle area due to a higher affinity of pigment to water. During periods of storage or non-use, pigment particles may settle or crash out of the ink vehicle, which may impede or block ink flow to the ejection chambers and nozzles in the printhead.

In some examples, other factors related to "decap", such as evaporation of water or solvent may cause PIVS and viscous ink plug formation. Decap is the amount of time inkjet nozzles can remain uncapped and exposed to ambient environments without causing degradation in the ejected ink drops.

Some examples of the present disclosure may reduce printing fluid blockage and/or clogging in printing systems by recirculating fluid between fluid supply slots (i.e. from slot-to-slot) or by recirculating fluid from ejection chamber to ejection chamber, slot to ejection chamber, pump chamber to slot, pump chamber to ejection chamber, etc.

In some examples, fluid may circulate between the slots and/or chambers through fluidic channels that may or may not include pump chambers having pump actuators to pump the fluid.

Referring to FIG. 4, an example method 400 of recirculating fluid in a printhead die comprises, at box 402, processing of print data 124 (cf. FIG. 1). The print data may be processed by controller 110 (cf. FIG. 1), e.g. by a processor of controller 110. In some examples, print data 124 may represent a document, a file, an image or an object to be printed. In some examples, print data 124 may include one or more print job commands and/or command parameters. Thus, as explained above, by processing the print data 124, the controller can control the timing of drop ejection and which nozzle(s) have to eject drops.

In some examples, the recirculation is performed for at least one nozzle 116, such that the recirculation finishes before complete ejection of a drop by the corresponding nozzle(s) 116.

In some examples, recirculation for nozzle(s) 116 is performed by activating the corresponding recirculation pumps. In some examples, recirculation is performed for each nozzle separately and each nozzle is in communication with a corresponding pump. In some examples, on pump is provided for each nozzle. In other examples, one pump is provided for more than one nozzle. For example, on pump may be provided for two nozzles or for a group of nozzles comprising a plurality of nozzles, such as three or five nozzles, or in the order of 50 nozzles.

In some examples, the timing of recirculation is controlled such that the recirculation finishes before the corresponding nozzle(s) 116 eject a drop. For example, the timing may be controlled such that the recirculation finishes shortly before drop ejection, e.g. in the order of milliseconds before drop ejection. In other examples, the recirculation may finish during a start phase of drop ejection, but before complete ejection of the drop. For example, the recirculation may finish while the corresponding thermal actuator heats up printing fluid and/or while a bubble forms within the ejection chamber which starts to force printing liquid out of the nozzle.

In some examples, the print data 124 is processed in advance to determine which nozzle(s) 116 will eject a drop and/or when the corresponding nozzle(s) 116 will eject the drop.

Referring to FIG. 4, the example method 400 comprises, at box 404, determining a nozzle score.

In some examples, a nozzle score is determined for each nozzle. In other examples, a nozzle score may be determined for a selected number of nozzles on a pre nozzle basis. In some examples, a nozzle score may be determined for a group of nozzles comprising a number of nozzles.

In some examples, the nozzle score is determined to estimate the nozzle status, e.g. when it is about to print a drop. The nozzle status may be indicative of the decap situation of the corresponding nozzle. If, for example, the nozzle is in a bad decap situation when it is about to print a drop, it may need recirculation in order to perform the drop ejection correctly.

In some examples, the nozzle score accumulates the number of blank columns since last drop. As explained above, inkjet printheads may have problems with printing fluid blockage and/or clogging due to an excess of air that accumulates as air bubbles in the printhead. In some examples, pigment-based inks may also cause printing fluid blockage or clogging in printheads due to pigment-ink vehicle separation (PIVS). During periods of storage or non-use, pigment particles may settle or crash out of the ink vehicle, which may impede or block ink flow to the ejection chambers and nozzles in the printhead.

In some examples, the nozzles 116 are capped while the printer is not printing. While printing, however, the nozzles 116 remain uncapped, whether they are about to eject a drop or not. Thus, in some examples, a nozzle or a number of nozzles may remain uncapped and exposed to ambient environments while they are not ejecting drops for a number of columns, i.e. for a number of blank columns. Thus, the nozzle score may be converted in time of non-use of the corresponding nozzle(s) using the printing firing frequency. Accordingly, in some examples, a nozzle score for a particular nozzle may be based at least in part on a time between drop ejections performed with the particular nozzle. In other words, a nozzle score for a particular nozzle may be based at least in part on use and/or non-use of the particular nozzle, where such use and/or non-use for the particular nozzle may be determined based at least in part on the print data.

In some examples, the nozzles score may accumulate up to several seconds. In some examples, the nozzle score may be a print resolution. In other examples, the nozzle score may not be a print resolution.

Referring to FIG. 4, the example method 400 comprises, at box 406, comparing the nozzle score with a recirculation threshold.

In some examples, at least one recirculation threshold is provided. For example, one recirculation threshold may be provided. In other examples, more than one recirculation threshold, such as, e.g. four recirculation thresholds may be provided. For example, having more than one recirculation threshold may provide flexibility to address different nozzle situations.

In some examples, for each drop to be ejected it has to be determined whether the corresponding nozzle needs recirculation or not. In other examples, it may be determined whether the corresponding nozzle needs recirculation or not for a selected number of drops to be ejected, for example for every second drop or for one drop out of, e.g. ten drops to be ejected. In order to determine whether a nozzle or a group of nozzles needs recirculation or not, the recirculation threshold may be utilized. Therefore, in some examples, whether to perform recirculation for a particular nozzle may be determined immediately prior to drop ejection with the particular nozzle.

If the nozzle score exceeds the recirculation threshold shortly before ejecting a drop, a recirculation process is produced, otherwise no recirculation needs to be performed, as shown at box 406 in FIG. 4.

In the case of more than one recirculation threshold, the nozzle score is compared to all or at least some of the recirculation thresholds. For example, if the nozzle score exceeds one of the recirculation thresholds, it may be determined whether another one of the recirculation thresholds is above the nozzle score or not.

For example, in the case of four recirculation thresholds, e.g. a first recirculation threshold $t_0$ of 4000, a second recirculation threshold $t_1$ of 3000, a third recirculation threshold $t_2$ of 2000, and a fourth recirculation threshold $t_3$ of 1000, it may be determined whether the nozzle score exceeds the first recirculation threshold. If it does, a recirculation process may be produced. If it does not exceed the first threshold, it may be determined whether it exceeds the second threshold, and so forth. As long as the nozzle score does not exceed a recirculation threshold, no recirculation process is produced. As soon as the nozzle score exceeded a particular threshold, a recirculation process is initiated and no further comparison of the nozzle score to remaining thresholds may be necessary.

In some examples, a recirculation length is provided. For example, one recirculation length may be provided. In other examples, more than one recirculation lengths may be provided, such as two or more recirculation lengths. In some examples, a recirculation length is provided for each recirculation threshold that is provided.

The recirculation length may indicate the length of the recirculation process, i.e. its duration. In the case that a recirculation length is provided for each recirculation threshold, it may be possible to produce recirculation processes with different lengths (durations) depending on the nozzle score value, i.e. on the particular threshold that the nozzle score exceeds.

In some examples, a recirculation may be performed for each nozzle for which the nozzle score exceeds a corresponding recirculation threshold. In some examples, a recirculation may be performed a group of nozzles for which the nozzle score exceeds the corresponding recirculation threshold, or which comprises a number of nozzles for which the nozzle score exceeds the corresponding recirculation threshold.

For example, a group of nozzles may comprise a number of nozzles, e.g. 20 nozzles. A recirculation may be performed for this group of nozzles, e.g. for the particular 20 nozzles, if the nozzle score for a fraction of these nozzles, e.g. one half of the group of nozzles, i.e. 10 nozzles, exceeds the corresponding threshold. A recirculation may be performed for a group of nozzles when some or all nozzles of that group of nozzles are about to eject a drop. For example, a recirculation may be performed if a fraction of the nozzles of a group of nozzles is about to eject a drop and if the nozzle score for that group of nozzles or for some or all nozzles of that group exceeds a corresponding recirculation threshold.

A recirculation is initiated by generating a number of recirculation pulses, as indicated at box 408.

In some examples, the number of recirculation pulses is applied on one pump or pump actuator for each nozzle, as shown at box 410 in FIG. 4. For example, one pump may be provided for each nozzle and may be in communication with that nozzle. In other examples, one pump may be provided for a group of nozzles, such as two or more nozzles and that pump may be in communication with each nozzle of that group of nozzles. In some examples, the number of recirculation pulses is applied on more than one pump for each nozzle.

In some examples, the recirculation pulses activate the pumps, such that flow of fluid may be generated. In some examples, the number of recirculation pulses is generated based on the processed print data. In some examples, the print data is processed in advance, such that the number of generated before complete ejection of a drop by the corresponding nozzle(s).

In some examples, the print data is processed in advance such that the controller knows in advance which nozzle(s) are about to eject a drop. In some examples, the controller may control the generation and application of recirculation pulses, such that in particular for those nozzle(s) which are about to eject a drop and which are in a bad decap situation, i.e. for which the nozzle score exceeds a corresponding threshold, a recirculation is performed. Furthermore, in some examples, the pattern of recirculation pulses generated may be based at least in part on a respective recirculation threshold for which a respective nozzle has exceeded. For example, a first pattern of recirculation pulses may be generated for a respective nozzle if the respective nozzle exceeds a first recirculation threshold. Continuing the example, a second pattern of recirculation pulses may be generated for the respective nozzle if the respective nozzle exceeds a second recirculation threshold. It may be appreciated that patterns of recirculation pulses may differ in total duration, pulse duration, frequency, etc.

Figure 5:
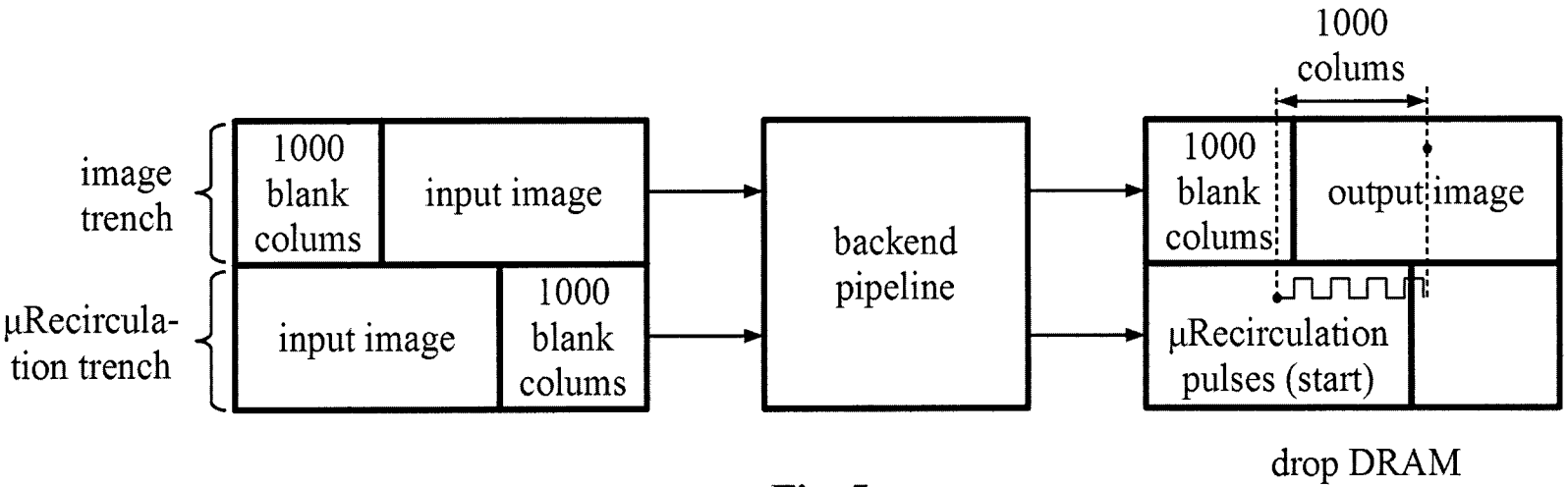
FIG. 5 illustrates an example method for anticipating the generation of recirculation pulses according to an example.

Referring to FIG. 5, an exemplary concept of how to process print data in advance for the recirculation is shown.

In some examples, it may be determined in advance whether a nozzle needs recirculation, so that the recirculation process may be performed before the drop is ejected. For example, some printheads contain several trenches, with a different color in each trench. A leading trench starts printing first and the others may be delayed so that the resulting image has all colors properly aligned on print media. In other words, leading trench must process the image, i.e. the print data, in advance.

A similar approach may be implemented for the recirculation. In some examples, each trench may be split in two different virtual trenches. One virtual trench may contain some or all the nozzles and the other virtual trench may contain some or all the pumps. The two virtual trenches my process the same exact input image with the same exact configuration, such that they generate the same exact drops. However, the virtual trench with the pumps may be processed in advance, as many columns as necessary to fit the train of recirculation pulses when required.

A printhead with recirculation support may be controlled as a very large printhead with its trenches set very far away. This concept is shown in FIG. 5. In some examples, the virtual trench including the pumps is processed a number of columns, e.g. 1000 columns, before the virtual trench that contains the nozzles. They process the same input image, i.e. the same print data. When a nozzle that is about to eject a drop requires recirculation, the virtual trench containing pumps sees this drop, e.g. 1000 columns in advance and generates the train of recirculation pulses such that the recirculation finishes just before, or a configurable time earlier than the trench with nozzles ejects the drop.

In some examples, heat may be built up in the printhead due to recirculation. In some examples, this built up heat, or at least part of it, is dissipated by the subsequent ejection of a drop.

In some examples, the recirculation pulses may actuate the pumps based directly on to-be-printed image areas without determining which particular nozzles are about to eject a drop.

In some examples, various flush "points" in a single die where heat is dissipated may be determined to initiate circulation in adjacent channels. In other examples, flush "areas" within a single die where heat is dissipated may be determined to initiate circulation in adjacent channels.

In some examples, recirculation during drop ejection may be avoided by timing the recirculation such that it finishes before drop ejection. In other examples, recirculation may finish during an initial start phase of drop ejection.

In some examples, recirculation is only performed for nozzles which are about to print. For example, it may be avoided to perform recirculation for a nozzle that is not about to print for a while, even if the corresponding nozzle score exceeded a recirculation threshold, since the heat that may be built up during recirculation may not be dissipated by subsequent ejection of a drop.

In some examples, a recirculation frequency pattern is determined. In some examples, one recirculation frequency pattern is determined. In other examples, more than one recirculation frequency pattern may be determined.

A recirculation frequency is a frequency with which the recirculation pulses are sent to the pump actuators. The maximum recirculation frequency may be the same as the printing frequency for the fire pulses. The recirculation frequency may be a fraction of the fire frequency, e.g. one half the fire frequency. This may be achieved by not generating pulses for all the columns.

In some examples, pumps are digitally driven as the rest of nozzles, pulses may only be generated in regular printing columns. Therefore, the maximum possible recirculation frequency may be the same as the print firing frequency. In this case, the train of pulses will contain a pulse in every single firing column. Lower frequencies can be achieved not generating pulses in all the columns. In order to configure the recirculation frequency, a frequency pattern of a particular length, e.g. a 16-bit frequency pattern, may be provided. The train of pulses may be constructed by repeating this pattern all over the columns.

Figure 6:
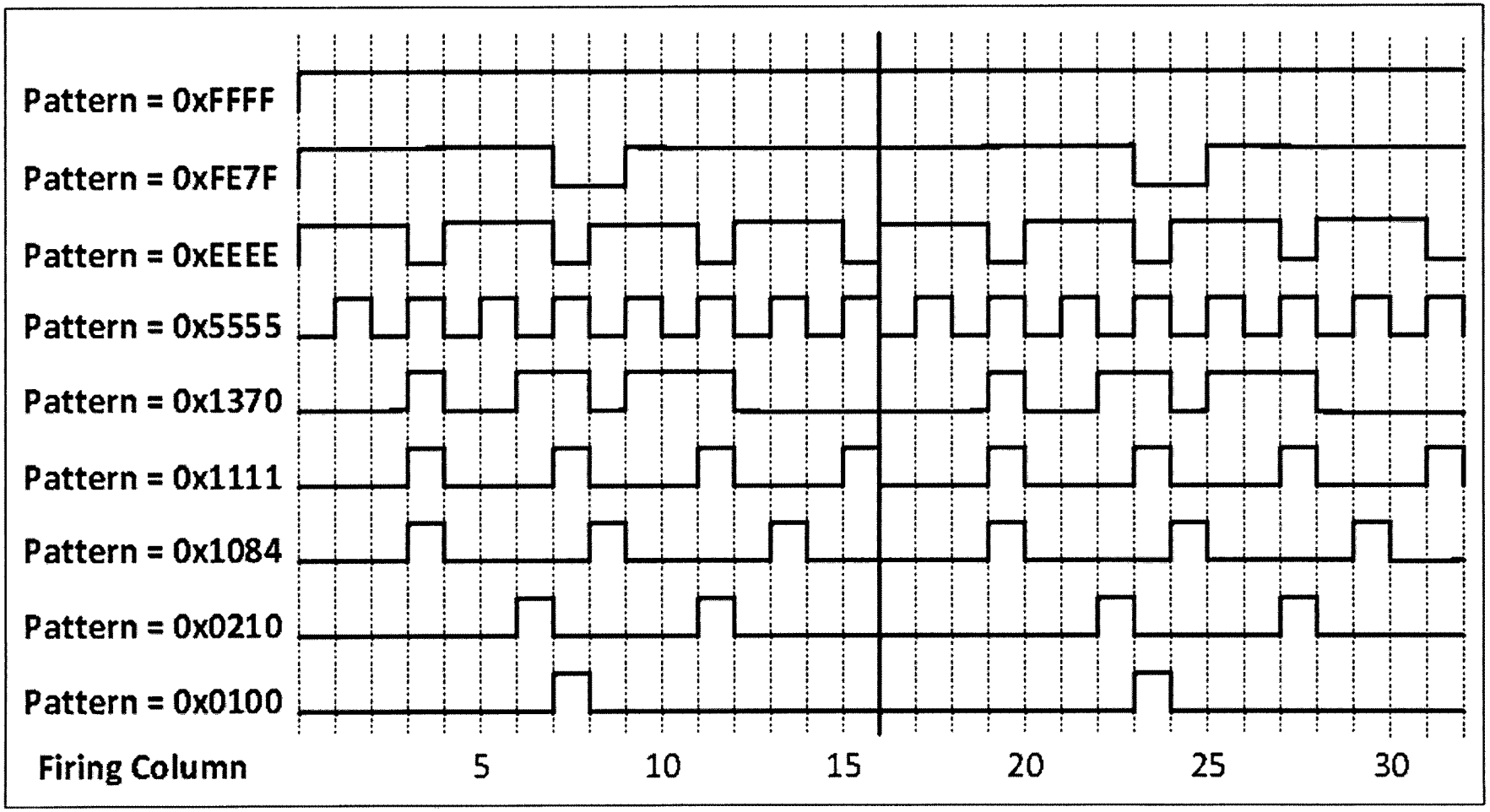
FIG. 6 illustrates an example of recirculation frequency patterns according to an example.

FIG. 6 illustrates 32 columns of train of pulses for different frequency patterns. As it can be seen, the maximum frequency is achieved with pattern 0xFFFF. It is possible to reduce frequency to half or one forth with patterns 0x5555 or 0x1111, respectively. The recirculation frequency is determined by the number of bits asserted in the frequency pattern, so 16 different fractions of the print firing frequency may be possible.

Figure 7:
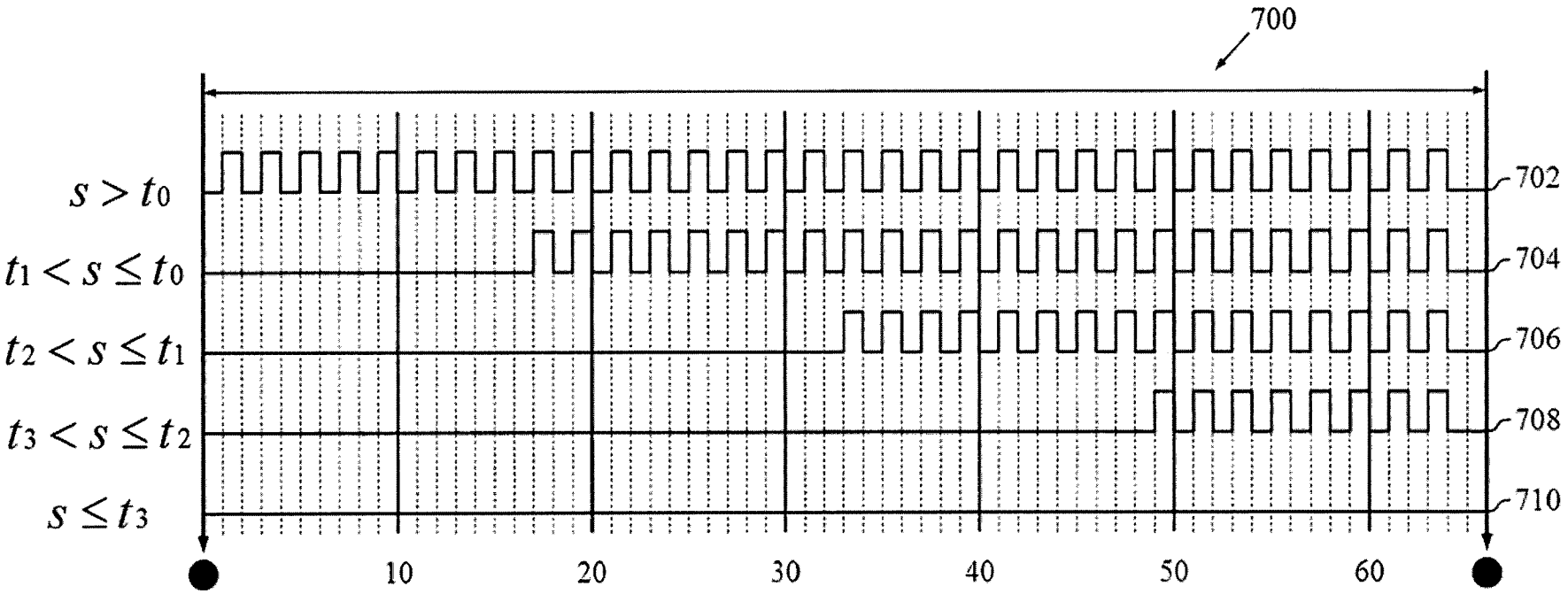
FIG. 7 illustrates an example of different recirculation lengths according to different recirculation thresholds and the corresponding application of a recirculation frequency pattern according to an example.

In the exemplary case shown in FIG. 7, the frequency pattern is 0x5555, so the recirculation generates a pulse every second column. The programmed shift between the recirculation slot and the regular slot may be, e.g. 66 columns, so the left part of the figure shows the moment when a drop is seen by the recirculation virtual trench and the right of the figure when the same drop is seen by the regular virtual trench 66 columns later. These columns are enough to fit all the trains of pulses.

The bottom part of the figure shows the definition for four recirculation thresholds, namely a first recirculation threshold $t_0$ of 4000 (topmost pattern), a second recirculation threshold $t_1$ of 3000 (second pattern from the top), a third recirculation threshold $t_2$ of 2000 (third pattern from the top), and a fourth recirculation threshold $t_3$ of 1000 (penultimate pattern). The final pattern at the bottom shows the situation in the case that the nozzle score s does not exceed any of the four different thresholds.

Each unit in the number of cycles or blank cycles represents 16 printing columns, a full frequency pattern. The central part of the figure shows the five possible actions that are possible when the drop is seen by the recirculation trench depending on the nozzle score s at that moment.

For example, in the case that the nozzle score s may be below the lowest threshold $t_3$, which may be e.g. 1000, no recirculation is performed at all (lowest pattern). In the exemplary case that the nozzle score s may exceed $t_3$, but still be lower than a further threshold $t_2$, e.g. of 2000, three initial blank cycles may be performed before one recirculation pattern is initiated (second lowest pattern). In the exemplary case that the nozzle score s may exceed $t_2$, but still be lower than a third threshold $t_1$, e.g. of 3000, two initial blank cycles may be performed before two recirculation patterns are initiated (middle pattern). In the exemplary case that the nozzle score s may exceed $t_1$, but still be lower than a fourth threshold $t_0$, e.g. of 4000, one initial blank cycle may be performed before three recirculation patterns are initiated (second pattern from the top). If, however, the nozzle score s may exceed the fourth and largest threshold $t_0$, no initial blank cycles are preformed and the recirculation pattern is initiated four times (topmost pattern).

In any of these exemplary cases, the distance between the end of the recirculation process and the drop ejection is two columns, this is implicitly defined with the difference between the shift between virtual trenches (66 in this case) and the number of columns required for the train of pulses (64 in this case).

Figure 8:
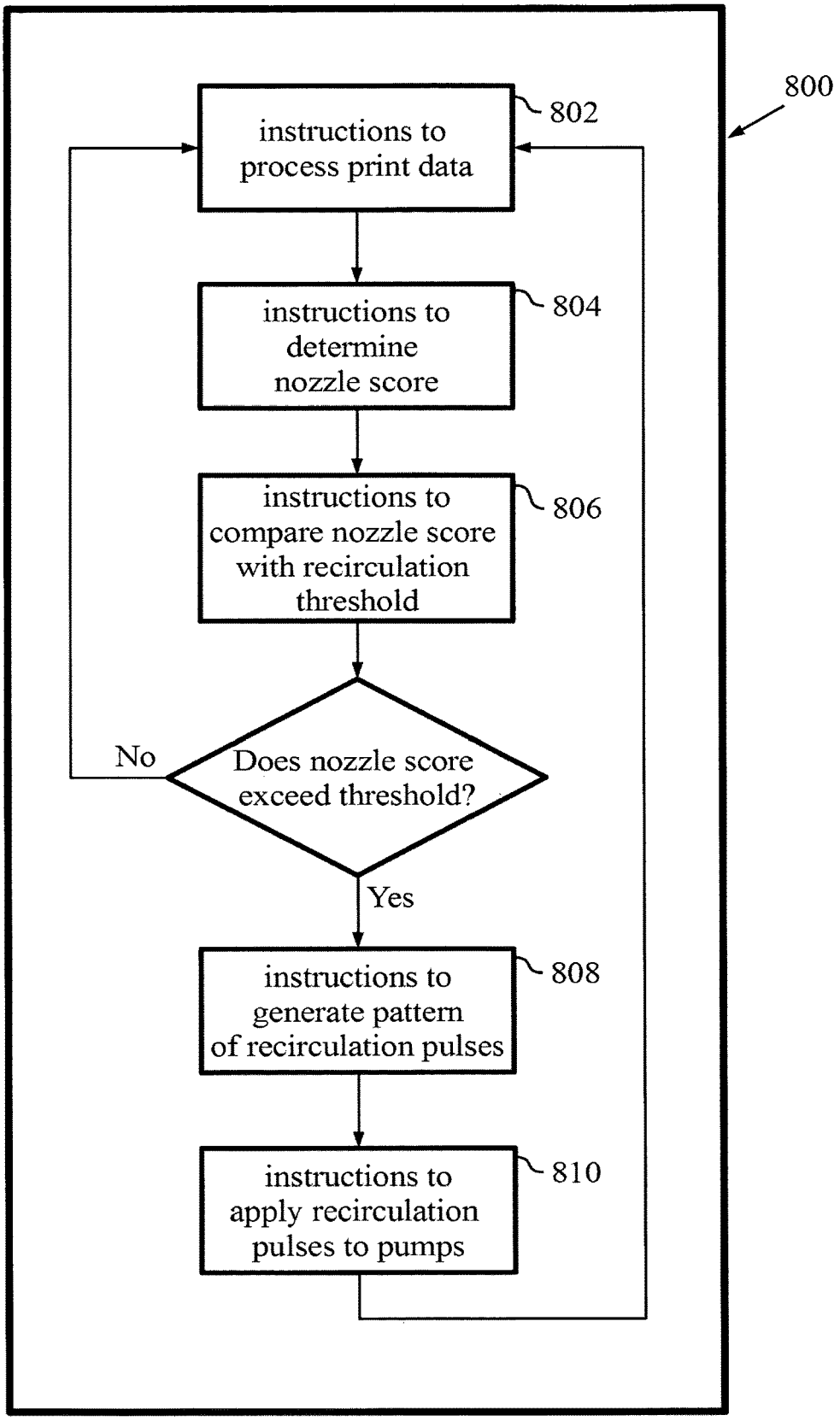
FIG. 8 illustrates an example of a non-transitory computer readable medium encoded with instructions according to an example.

FIG. 8 illustrates a non-transitory computer readable medium 800. The medium 800 may be any kind of non-transitory computer readable medium, such as, e.g. a CD-ROM or the like. In some examples, the medium 800 may be encoded with instructions 802. 804, 806, 808, 810. In some examples, the instructions may be executable by, e.g. a processor, for example a computer processor. In some examples, the medium 800 may be encoded with instructions 802 that, when executed by a processor, cause the processor to process print data. In some examples, the medium 800 may be encoded with instructions 804 that, when executed by a processor, cause the processor to determine a nozzle score. In some examples, the medium 800 may be encoded with instructions 806 that, when executed by a processor, cause the processor to compare the nozzle score with a recirculation threshold. In the exemplary case that the nozzle score does not exceed the threshold, the instructions may cause the processor to continue to process print data. Otherwise, in the exemplary case that the nozzle score does exceed the threshold, the instructions may cause the processor to generate a recirculation pattern, i.e. a pattern of recirculation pulses. For this reason, in some examples, the medium 800 may be encoded with instructions 808 that, when executed by a processor, cause the processor to generate a pattern of recirculation pulses. Moreover, in some examples, the medium 800 may be encoded with instructions 810 that, when executed by a processor, cause the processor to apply the recirculation pulses to pumps.

In some examples, a non-transitory computer readable medium encoded with instructions is provided, that, when executed by a processor, cause the processor to perform a method of recirculating fluid in a printhead die, wherein the recirculation is performed for at least one nozzle, such that the recirculation finishes before complete ejection of a drop by the corresponding at least one nozzle.

In some examples, the non-transitory computer readable medium is further encoded with instructions, that, when executed by a processor, cause the processor to determine a nozzle score for each nozzle. In some examples, the nozzle score accumulates the number of blank columns since the last drop for each nozzle.

In some examples, the non-transitory computer readable medium is further encoded with instructions, that, when executed by a processor, cause the processor to provide at least one recirculation threshold.

In some examples, the non-transitory computer readable medium is further encoded with instructions, that, when executed by a processor, cause the processor to determine a recirculation length for each recirculation threshold.

In some examples, the non-transitory computer readable medium is further encoded with instructions, that, when executed by a processor, cause the processor to perform the recirculation for each nozzle for which the nozzle score exceeds the corresponding recirculation threshold or for each group of nozzles comprising a number of nozzles for which the nozzle score exceeds the corresponding recirculation threshold.

In some examples, the non-transitory computer readable medium is further encoded with instructions, that, when executed by a processor, cause the processor to apply a number of recirculation pulses on at least one pump for each nozzle or for each group of nozzles.

In some examples, the non-transitory computer readable medium is further encoded with instructions, that, when executed by a processor, cause the processor to process print data in advance and to generate the number of recirculation pulses based on the processed print data, such that the number of recirculation pulses finishes before complete ejection of a drop by the corresponding at least one nozzle.

In some examples, the non-transitory computer readable medium is further encoded with instructions, that, when executed by a processor, cause the processor to process the print data in advance to determine which at least one nozzle will eject a drop and when the corresponding at least one nozzle will eject the drop.

In some examples, the non-transitory computer readable medium is further encoded with instructions, that, when executed by a processor, cause the processor to determine at least one recirculation frequency pattern.

In some examples, the non-transitory computer readable medium is further encoded with instructions, that, when executed by a processor, cause the processor to perform the recirculation for each nozzle or group of nozzles by generating a number of recirculation pulses according to the recirculation frequency pattern and the corresponding recirculation length.#

In some examples, a non-transitory computer readable medium encoded with instructions is provided, that, when executed by a processor, cause the processor to perform a method of recirculating fluid in a printhead die, wherein heat that has built up during the recirculation is dissipated by the ejection of a drop.

In some examples, a printing system is provided, comprising a printhead assembly including at least one printhead having a printhead die and at least one nozzle, a printing fluid supply assembly which is in fluid communication with the printhead assembly, and a controller, wherein the controller is to control a method of recirculating fluid in a printhead die, wherein the recirculation is performed for at least one nozzle, such that the recirculation finishes before complete ejection of a drop by the corresponding at least one nozzle.

In some examples, the controller of the printing system is further to determine a nozzle score for each nozzle. In some examples, the nozzle score accumulates the number of blank columns since the last drop for each nozzle.

In some examples, the controller of the printing system is further to provide at least one recirculation threshold.

In some examples, the controller of the printing system is further to determine a recirculation length for each recirculation threshold.

In some examples, the controller of the printing system is further to perform the recirculation for each nozzle for which the nozzle score exceeds the corresponding recirculation threshold or for each group of nozzles comprising a number of nozzles for which the nozzle score exceeds the corresponding recirculation threshold.

In some examples, the controller of the printing system is further to apply a number of recirculation pulses on at least one pump for each nozzle or for each group of nozzles.

In some examples, the controller of the printing system is further to process print data in advance and to generate the number of recirculation pulses based on the processed print data, such that the number of recirculation pulses finishes before complete ejection of a drop by the corresponding at least one nozzle.

In some examples, the controller of the printing system is further to process the print data in advance to determine which at least one nozzle will eject a drop and when the corresponding at least one nozzle will eject the drop.

In some examples, the controller of the printing system is further to determine at least one recirculation frequency pattern.

In some examples, the controller of the printing system is further to perform the recirculation for each nozzle or group of nozzles by generating a number of recirculation pulses according to the recirculation frequency pattern and the corresponding recirculation length.

In some examples, the controller of the printing system is further to perform a method of recirculating fluid in a printhead die, wherein heat that has built up during the recirculation is dissipated by the ejection of a drop.

While several examples have been described in detail, it is to be understood that the disclosed examples may be modified. Therefore, the foregoing description is to be considered non-limiting.

What is claimed is:

1. A method of recirculating fluid in a printhead die, wherein the recirculation is performed for at least one nozzle, such that the recirculation finishes before complete election of a drop by the corresponding at least one nozzle, wherein a nozzle score is determined for each nozzle.

2. The method of claim 1, wherein the nozzle score accumulates a number of blank columns since the last drop for each nozzle.

3. The method claim 1, wherein at least one recirculation threshold is provided.

4. The method of claim 3, wherein a recirculation length for each recirculation threshold is determined.

5. The method of claim 4, wherein the recirculation is performed for each nozzle for which the nozzle score exceeds the corresponding recirculation threshold or for each group of nozzles comprising a number of nozzles for which the nozzle score exceeds the corresponding recirculation threshold.

6. The method of any of claim 5, wherein a number of recirculation pulses is applied on at least one pump for each nozzle or for each group of nozzles.

7. The method of claim 6, wherein print data is processed in advance and the number of recirculation pulses is generated based on the processed print data, such that the number of recirculation pulses finishes before complete ejection of a drop by the corresponding at least one nozzle.

8. The method of claim 7, wherein the print data is processed in advance to determine which at least one nozzle will eject a drop and when the corresponding at least one nozzle will eject the drop.

9. The method of claim 8, wherein at least one recirculation frequency pattern is determined.

10. The method of claim 9, wherein the recirculation is performed for each nozzle or group of nozzles by generating a number of recirculation pulses according to the recirculation frequency pattern and the corresponding recirculation length.

11. The method of claim 10, wherein heat that has built up during the recirculation is dissipated by the ejection of a drop.

12. A printing system, comprising a printhead having a plurality of nozzles, the printhead being configured to eject fluid from a nozzle by activating a fluidic actuator which is in fluid communication with the nozzle; and a controller;

wherein the controller is to control a method of recirculating fluid in the printhead, the method comprising:

determining a nozzle score for each nozzle or for a group of nozzles;

determining whether the nozzle score exceeds each of a plurality of recirculation thresholds, wherein each of the plurality of recirculation thresholds corresponds to a pattern of recirculation pulses of different patterns of recirculation pulses; and if the nozzle score exceeds any of the plurality of recirculation thresholds, performing the recirculation based on the pattern of recirculation pulses corresponding to the exceeded recirculation threshold by actuating pump actuators;

wherein the recirculation finishes before complete ejection of a drop by the corresponding nozzle.

13. The printing system of claim 12, wherein the different patterns of recirculation pulses differ in at least one of total duration, pulse duration and frequency.

14. The printing system of claim 13, wherein the nozzle score is determined by accumulating the number of blank columns since the last drop.

15. The printing system of claim 14, wherein the nozzle score is determined based at least in part on print data.

* * * * *